United States Patent [19]

Huang

[11] Patent Number: 4,787,296

[45] Date of Patent: Nov. 29, 1988

[54] VENTILATED SOUNDPROOF GLASS

[76] Inventor: Tao Hsuan Huang, 3F., No. 10, alley 18, Lane 10, Lin Sen Rd.,Yeong Ho., Taipei Hsien, Taiwan

[21] Appl. No.: 128,208

[22] Filed: Dec. 3, 1987

[51] Int. Cl.[4] ..... F24F 7/00

[52] U.S. Cl. ..... 98/96; 98/DIG. 10; 181/289

[58] Field of Search ..... 98/96, DIG. 10; 181/286, 288, 289, 293

[56] References Cited

U.S. PATENT DOCUMENTS 2,225,809 12/1940 Walker ..... 98/DIG. 10 X
2,870,700 1/1959 Harrington ..... 98/96
2,966,954 1/1961 Sabine ..... 181/289
3,789,747 2/1974 Wasserman et al. ..... 98/DIG. 10 X

*Primary Examiner*—Harold Joyce
*Attorney, Agent, or Firm*—Morton J. Rosenberg

[57] ABSTRACT

Ventilated soundproof glass including at least two sheets of glass and one sheet of plastic film in between. These two sheets of glass and the sheet of plastic film have holes arranged in them. The sides of the two sheets of glass adjacent to the sheet of plastic film have grooves, by which the air can pass through the ventilated soundproof glass while the noise is substantially reduced when it is propagating through the long courses of the grooves within the ventilated soundproof glass.

2 Claims, 7 Drawing Sheets

VENTILATED SOUNDPROOF GLASS

BACKGROUND OF THE INVENTION

This invention relates to ventilated soundproof glass which can be used in offices, houses or any other buildings, providing soundproofing effect while still maintaining ventilation.

Ordinary glass is not very effective in isolating noise or other sounds waves from propagation. It is true that there is a sort of glass being made of two layers of glass with a thin film in between, which provides much better soundproofing effect than ordinary glass. Nevertheless, when this type of glass is installed in a building, it is necessary to provide an air-conditioning system in the buildings because the glass is not capable of letting air go through.

In cities where noise pollution is a very serious problem, people tend to use the afore-mentioned glass in the mansions, thus consuming more energy in ventilation due to the continual use of air-conditioning.

SUMMARY OF THE INVENTION

It is, therefore, a primary objective of this present invention to provide a new type of glass which permits air to go through the glass while still preventing the sound from passing through it.

Further objectives and advantages of the present invention will become apparent as the following description proceeds.

DETAILED DESCRIPTION OF THE PREFERRED EMBODIMENT

Figure 1:
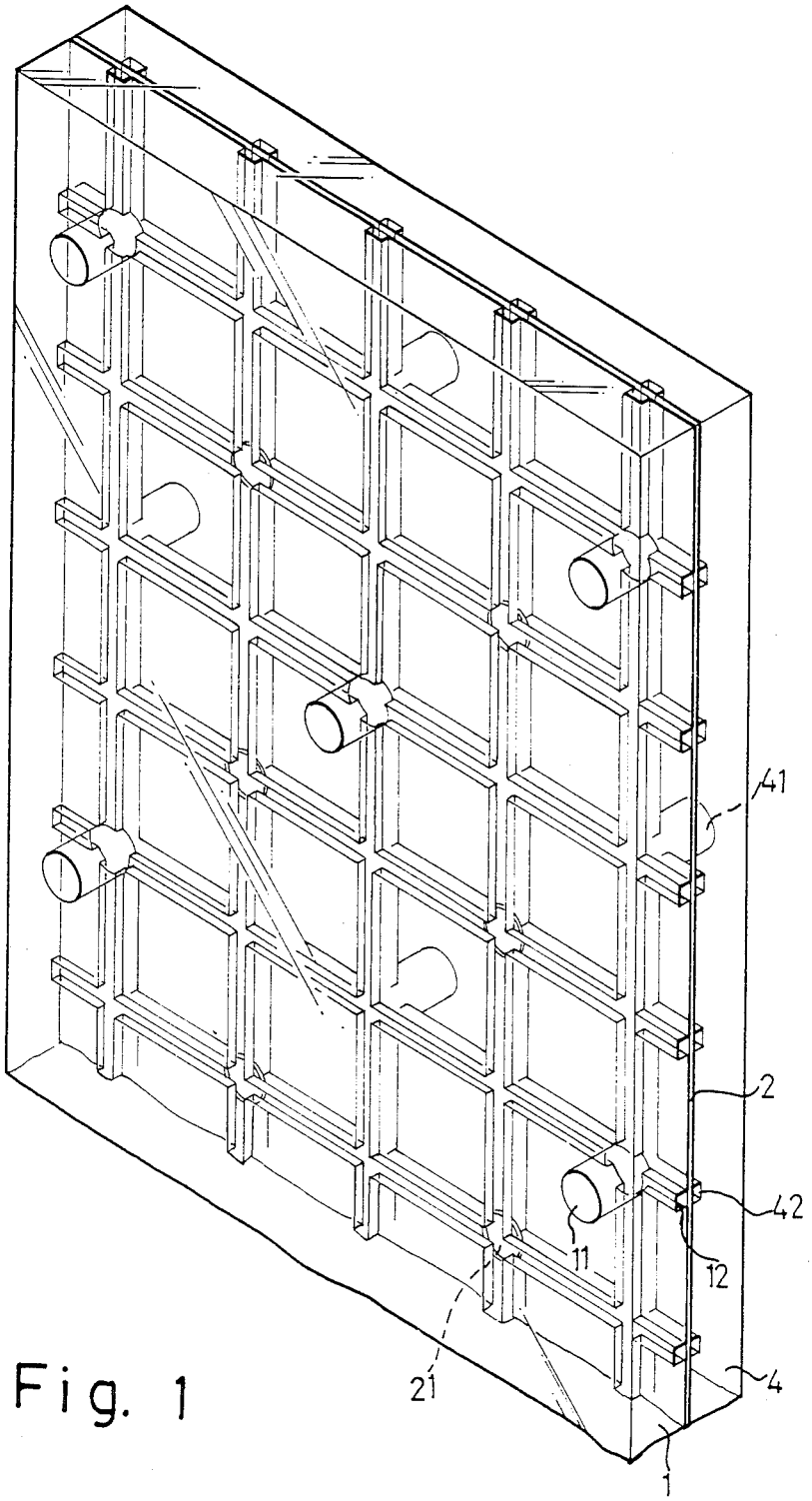
FIG. 1 is a perspective view of a first embodiment of ventilated soundproof glass in accordance with the present invention.

Referring to FIG. 1, an embodiment of a sheet of ventilated soundproof glass according to the present invention is shown. It can be seen that the ventilated soundproof glass consists of three parts, namely, a first sheet of glass 1, a second sheet of glass 4 and a sheet of plastic film 2 there between. The first sheet of glass 1 and second sheet of glass 4 can be made of ordinary glass or acrylic-plastics.

Figure 2:
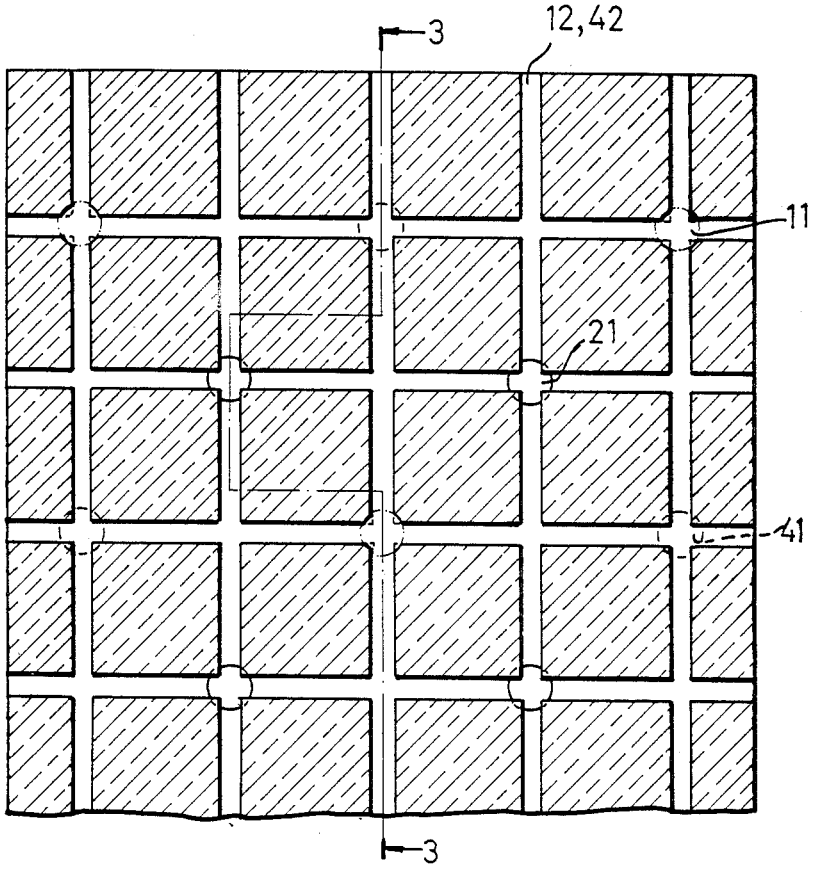
FIG. 2 is a plane view of the ventilated soundproof glass of FIG. 1.

Now, with further reference to FIG. 2, it can be seen that the first sheet of glass 1, the second sheet of glass 4 and the sheet of plastic film 2 all have a plurality of round holes arranged therein, respectively. The round holes in the first sheet of glass 1 are seen as solid circles 11 in FIG. 2, the round holes in the second sheet of glass 4 are represented by dotted circles 41, and the round circles in the sheet of plastic film 2 are represented by semidotted circles 21, respectively. These round holes in the three separate sheets are all in different vertical and horizontal positions. The first sheet of glass 1 has a plurality of vertical and horizontal grooves 12, being rectangular in cross-section, between the round holes at one side thereof adjacent to the sheet of plastic film 2, forming a pattern much like a chessboard. Each of the round holes 11, 21, 41 of the first sheet 1, the plastic film 2, and the second sheet 4, respectively, are aligned with particular intersections of the grooves 12 and 42, so as to allow for ventilation between the respective holes. The second sheet of glass 4 has also a plurality of groove 42 at one side there of adjacent to the sheet of plastic film 2, the grooves having exactly the same pattern as that of the first sheet of glass 1.

Figure 3:
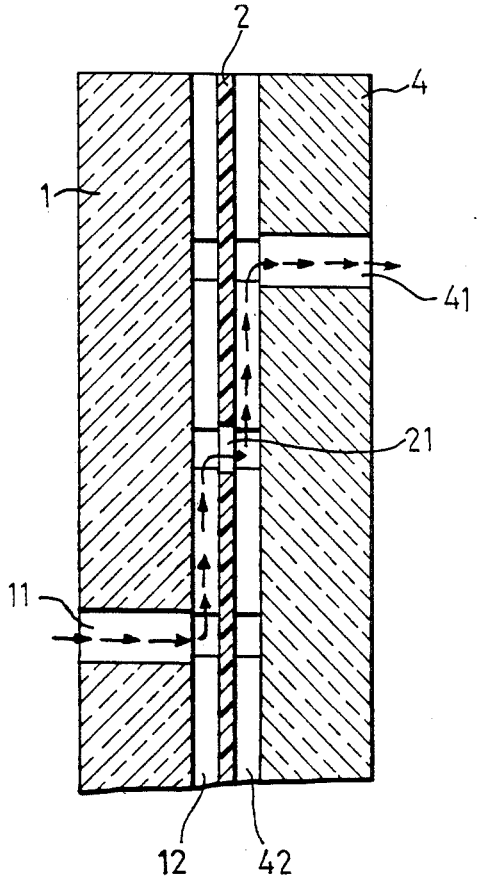
FIG. 3 is a cross-sectional view of the ventilated soundproof glass as seen from line 3—3 of FIG. 2.
Figure 4:
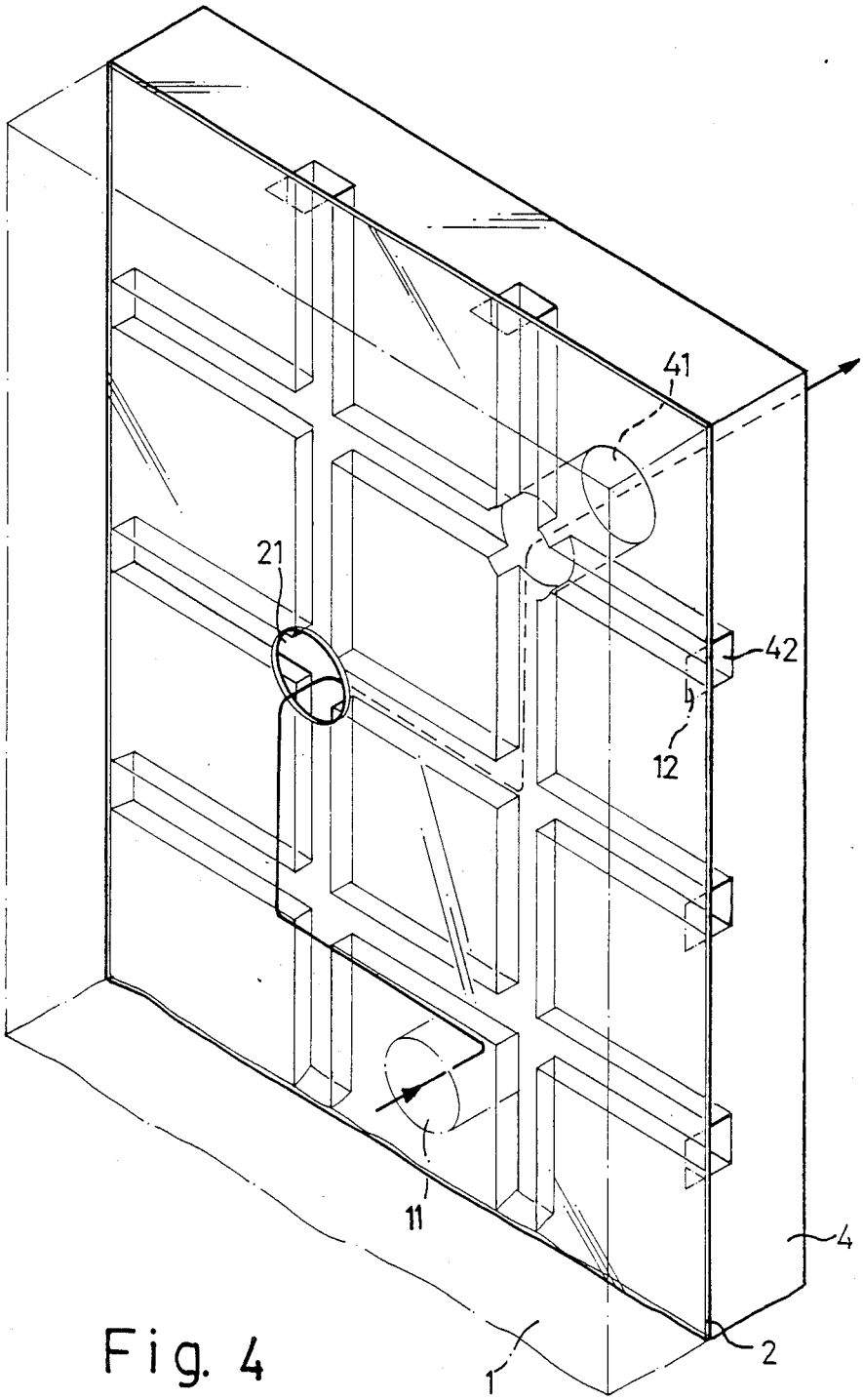
FIG. 4 is an enlarged view of a portion of FIG. 1.

Now referring to FIGS. 3 and 4, it can be observed that the air first goes through the round holes 11 in the first sheet of glass 1, then passes through the holes 21 in the sheet of plastic film 2 by way of the grooves 12 in the first sheet of glass 1, and then continues to proceed on through the grooves 42 in the second sheet of glass 4, and finally gets out through the round holes 41 in the second sheet of glass 4. When the ventilated soundproof glass is installed in a building, the building can be ventilated through the use of the ventilated soundproof glass in a manner as described above, while the sound waves, although being able to propagate through the round holes also, are substantially reduced due to the long courses of the grooves while the sound waves are propagating therethrough, much like the effects of a silencer. Furthermore, the plastic film 2 has also the effect of absorbing the sound.

Figure 5:
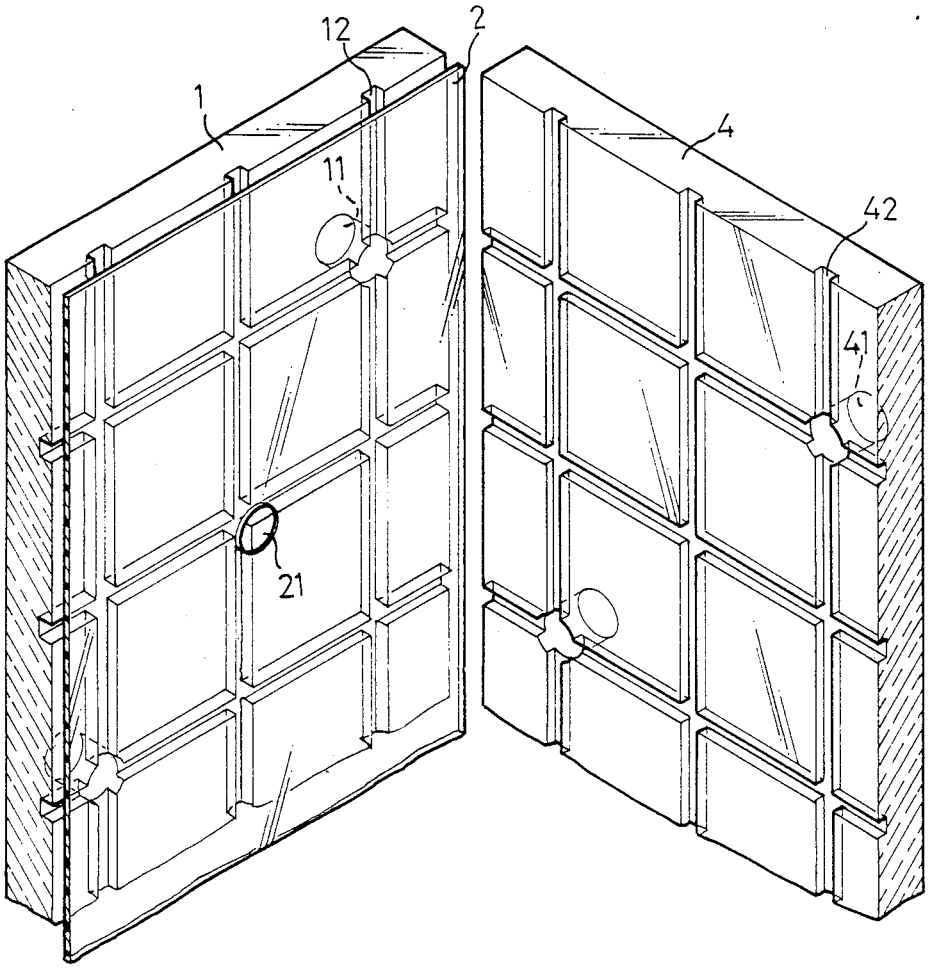
FIG. 5 is an exploded view of an embodiment of the ventilated soundproof glass of FIG. 1.
Figure 6:
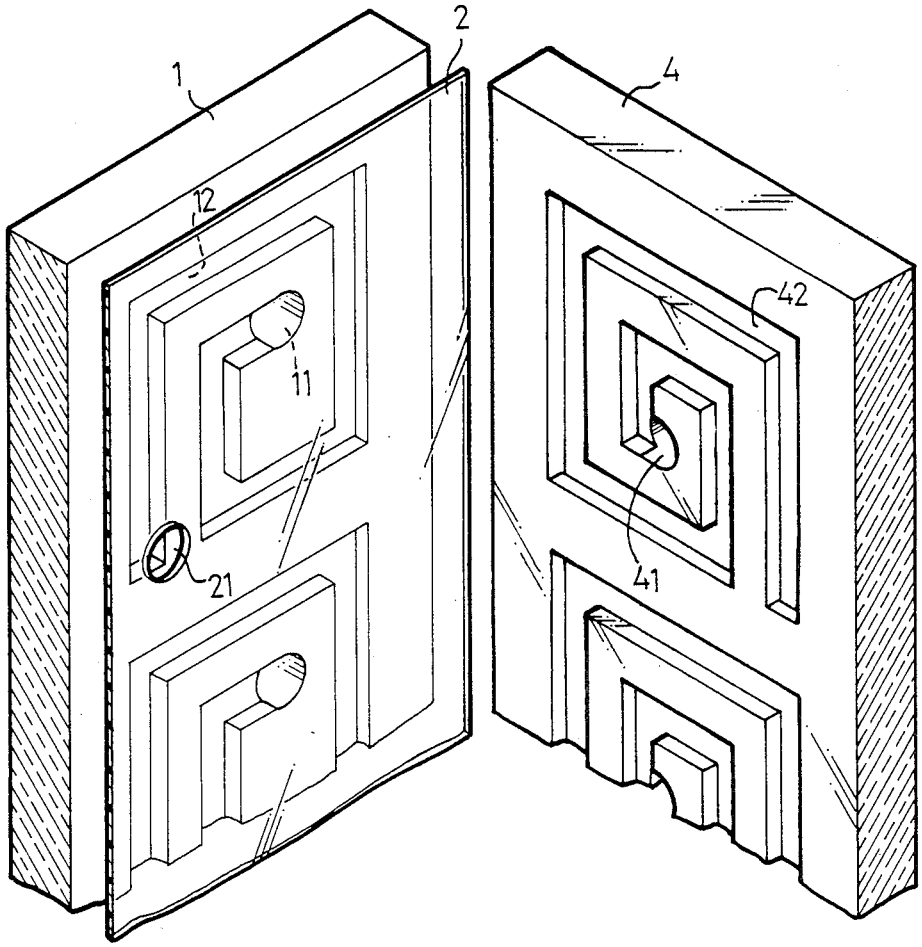
FIG. 6 is an exploded view of a second embodiment of ventilated soundproof glass in accordance with the present invention.
Figure 7:
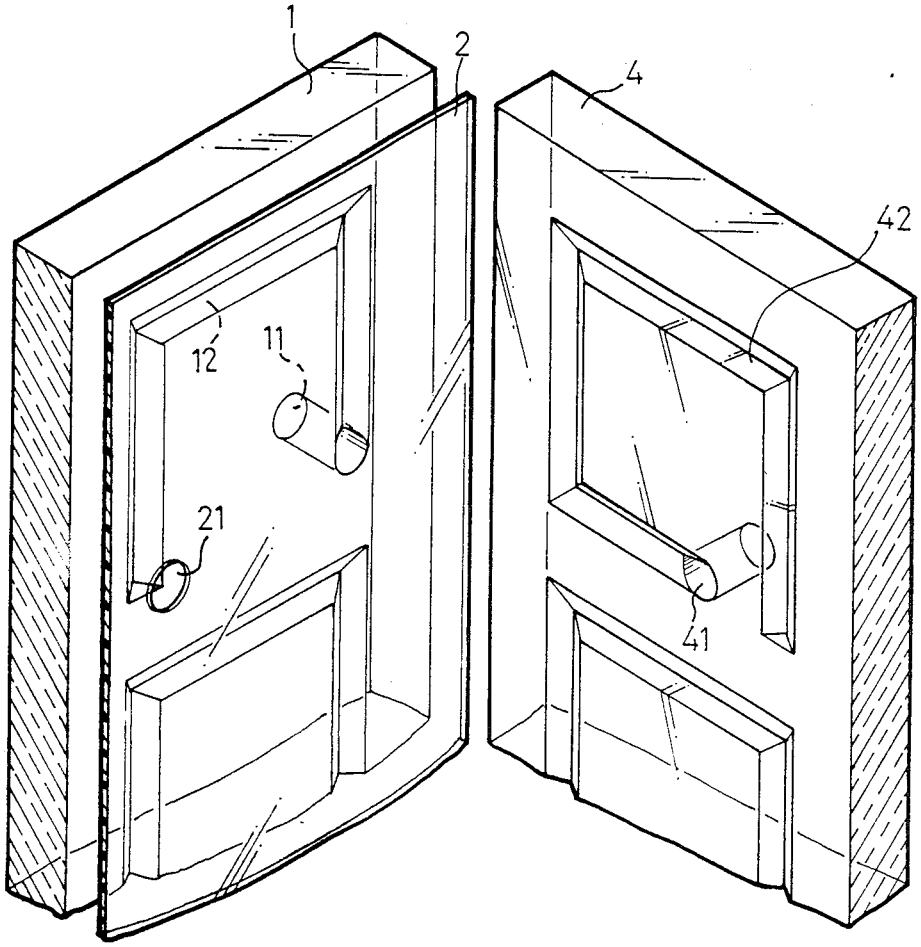
FIG. 7 is an exploded view of a third embodiment of ventilated soundproof glass in accordance with the present invention.

FIG. 5 gives another clear view of the first embodiment of ventilated soundproof glass. FIGS. 6 and 7 provide second and third embodiments of ventilated soundproof glass according to the present invention. The difference between these embodiments and the first embodiment lies in the configuration of the grooves 12 and 42 of the first sheet of glass 1 and second sheet of glass 4, respectively, but the above arguments about the propagation of the sound waves and noise apply too.

Likewise, the round holes 11 of the first sheet of glass 1 and the round holes 41 of the second sheet of glass 4 could alternately be other shapes besides round, and the cross-sections of the grooves of the first sheet of glass and second sheet of glass could alternately be other shapes besides rectangular, in the embodiments.

This ventilated soundproof glass can consist of more than two sheets of glass and one sheet of plastic film. For example, it can contain three sheets of glass with a sheet of plastic film between first sheet of glass and second sheet of glass and another sheet of plastic film between the second sheet of glass and the third sheet of glass, thereby enhancing the soundproofing effect. The last but not the least to be pointed out is that the sheet of plastic film 2 between the first sheet of glass 1 and second sheet of glass 4 can be of any color desired, thereby reducing the brightness of sunlight and giving a more beautiful appearance.

Thus far, it is to be appreciated that the present invention is a significant improvement over the prior art, and further explanation is believed unnecessary. Since various possible embodiments might be made of the above invention without departing from the scope of the invention, it is to be understood that all matter herein described or shown in the accompanying drawings is to be interpreted as illustrative and not in a limiting sense. Thus it will be appreciated that the drawings are exemplary of preferred embodiments of the invention and that the scope of the invention is to be limited only by the scope of the appended claims.

I claim:

1. Ventilated soundproof glass comprising: at least a first and a second sheet of glass with one sheet of plastic film there between, wherein said sheets of glass and said sheet of plastic film have a plurality of holes therein respectively; said holes of said first and second sheet of glass, and said sheet of plastic film being in different horizontal and vertical positions, one side of said first sheet of glass and one side of said second sheet of glass adjacent to said sheet of plastic film having a plurality of grooves arranged thereon between said holes of said first sheet of glass and said second sheet of glass respectively.

2. The ventilated soundproof glass of claim 1, wherein said holes of said first and second sheet of glass and said sheet of plastic film are round in shape, said grooves of said first sheet of glass and said second sheet of glass being rectangular in cross-section.

* * * * *